US005228596A

United States Patent [19]

McNally

[11] Patent Number: 5,228,596

[45] Date of Patent: * Jul. 20, 1993

[54] OUTWARDLY PROJECTING DIRECTED POUR SPOUT EXHIBITING THREAD COMPATIBLE CROSS-SECTIONAL PROFILE

[75] Inventor: Mark P. McNally, Cincinnati, Ohio

[73] Assignee: The Procter & Gamble Company, Cincinnati, Ohio

[ * ] Notice: The portion of the term of this patent subsequent to Jan. 26, 2110 has been disclaimed.

[21] Appl. No.: 717,754

[22] Filed: Jun. 19, 1991

[51] Int. Cl.[5] ..... B67D 1/16

[52] U.S. Cl. ..... 222/109; 222/571

[58] Field of Search ..... 222/109, 111, 551, 562, 222/572, 571; 220/288; 215/329

[56] References Cited

U.S. PATENT DOCUMENTS

| | | | |
|---|---|---|---|
| 1,156,784 | 10/1915 | King . | |
| 1,648,068 | 11/1927 | Shockley . | |
| 1,918,117 | 7/1933 | Martin . | |
| 1,925,913 | 9/1933 | Wood | 65/31 |
| 2,039,345 | 5/1936 | Ravenscroft | 215/31 |
| 2,535,871 | 12/1950 | Seigh | 222/542 |
| 2,587,344 | 2/1952 | Livingstone | 222/571 |
| 2,601,039 | 6/1952 | Livingstone | 222/109 |
| 2,657,838 | 11/1953 | Kramer et al. | 222/569 |
| 2,741,902 | 4/1956 | Thompson | 65/31 |
| 2,793,790 | 5/1957 | Kahler | 222/109 |
| 2,804,103 | 8/1957 | Wall | 141/381 |
| 3,102,667 | 9/1963 | Ullevig | 222/569 |
| 3,309,000 | 3/1967 | Haverstick | 222/569 |
| 3,434,637 | 3/1969 | Marcel | 222/570 |
| 3,700,146 | 10/1972 | Cousins et al. | 222/572 X |
| 3,833,150 | 9/1974 | Visser-Patings | 222/109 |
| 3,860,148 | 1/1975 | Sherin | 222/153 |
| 3,895,743 | 7/1975 | Christian | 222/143 |
| 3,961,732 | 6/1976 | Roberts | 272/570 |
| 4,078,700 | 3/1978 | Hidding | 222/109 |
| 4,298,145 | 11/1981 | Iida | 222/478 |
| 4,349,056 | 9/1982 | Heino | 141/381 |
| 4,494,682 | 11/1985 | Beckstrom et al. | 222/551 |
| 4,550,862 | 11/1985 | Barker et al. | 222/109 |
| 4,556,508 | 1/1986 | Bowyer | 141/381 |
| 4,566,509 | 1/1986 | Szajna | 141/381 |
| 4,591,078 | 5/1986 | Weissman | 222/517 |
| 4,630,761 | 12/1986 | Thomson | 222/572 X |
| 4,696,416 | 9/1987 | Muckenfuhs et al. | 222/109 |
| 4,706,829 | 11/1987 | Li | 215/354 |
| 4,741,459 | 5/1988 | Silvenis et al. | 222/23 |
| 4,802,597 | 2/1989 | Dubach | 215/307 |
| 4,850,501 | 7/1989 | Shield | 220/90.4 |
| 4,863,067 | 9/1989 | Krall | 222/111 |
| 4,890,770 | 1/1990 | Haga et al. | 222/109 |
| 4,917,268 | 4/1990 | Campbell et al. | 222/109 |
| 4,917,269 | 4/1990 | Fuchs et al. | 222/109 |
| 4,974,749 | 12/1990 | Mon | 222/111 |
| 4,981,239 | 1/1991 | Cappel et al. | 222/109 |
| 4,989,757 | 2/1991 | Krall | 222/111 |
| 4,993,605 | 2/1991 | Del'Re | 222/545 |

OTHER PUBLICATIONS

Co-pending commonly assigned U.S. Patent Application of Mark P. McNally entitled Vessel Having Dual Function Pouring Spout for Spot Treating or Rapid Transfer of Viscous Fluids, Ser. No. 717,456, filed Jun. 19, 1991.

*Primary Examiner*—Gregory L. Huson
*Attorney, Agent, or Firm*—E. Kelly Linman

[57] ABSTRACT

An externally threaded vessel having an outwardly projecting directed pour spout to permit substantially mess-free dispensing of liquid from the vessel. The tip of the outwardly projecting directed pour spout exhibits a cross-sectional profile which resides completely within the outline which would be formed if the external thread on the vessel were to be extended upwardly a sufficient distance to include the tip of the pour spout. Sizing and positioning the tip of the pour spout in the foregoing manner permits dispensing of liquid from the vessel without contaminating the external thread or the exterior surfaces of the vessel, yet permits engagement of the vessel with a secondary vessel having a complementary thread engaging means without any interference with the tip of the outwardly projecting directed pour spout. In essence, the cross-sectional profile of the tip of the outwardly projecting directed pour spout acts as an extension of the external thread on the vessel incorporating the pour spout.

7 Claims, 5 Drawing Sheets

OUTWARDLY PROJECTING DIRECTED POUR SPOUT EXHIBITING THREAD COMPATIBLE CROSS-SECTIONAL PROFILE

TECHNICAL FIELD

The present invention relates to a liquid dispensing vessel having a pour spout.

The present invention has further relation to such a liquid dispensing vessel having an outwardly projecting directed pour spout which will provide substantially mess-free dispensing of viscous liquids, such as laundry detergents, yet which will not interfere with engagement of the external thread on the vessel incorporating the spout with a secondary vessel having a complementary thread.

BACKGROUND ART

Pouring spouts on liquid vessels, such as bulk liquid containers and closures therefor, are well known in the art. These pouring spouts find particular utility when dispensing viscous liquids, such as laundry detergents, either directly onto articles of clothing to be spot treated or when rapidly transferring large quantities of liquid into a washing machine.

Most such vessels of the prior art are releasably secured to a secondary vessel by means of complementary helical threads, e.g., a closure releasably secured to a bulk liquid container. Accordingly, the outward projection of the pouring spout on either the bulk liquid container or the closure typically does not extend beyond the rim of the container in order to avoid interference with the complementary threads on the secondary vessel. When the pouring spout does not extend sufficiently far beyond the rim of the vessel to which it is attached, viscous liquid poured from the vessel may not completely clear the rim and/or the external threads on the vessel. Once liquid contaminates the rim and/or threads of the vessel in question, each successive liquid dispensing cycle becomes messier than the preceding cycle.

Accordingly, it is an object of the present invention to provide a vessel, which may comprise either a closure or a bulk liquid container, said vessel having a pour spout which extends beyond the outermost portion of the vessel's uppermost rim.

It is another object of the present invention to provide a first vessel, such as a closure, having an outwardly projecting pour spout that does not cause interference when said first vessel is applied to a secondary vessel, such as a bulk liquid container.

It is a further object of the present invention to provide a first externally threaded vessel having an outwardly projecting pour spout, said first vessel being releasably secured to a secondary vessel having a complementary internal thread, said outwardly projecting pour spout exhibiting a cross-sectional profile which fits within the confines of a hypothetical extension of the external thread on said first vessel.

DISCLOSURE OF THE INVENTION

A directed pouring spout extending beyond the outermost portion of the rim of an externally threaded vessel, whether it be a bulk container or a closure on a bulk container, allows for cleaner overall usage and controlled pouring of viscous liquids, such as when pretreating clothing with a liquid detergent or when rapidly transferring the liquid detergent from a bulk container into a washing machine. These improvements are particularly pronounced when compared to either a vessel without any pouring spout or a vessel that has a pouring spout that does not extend beyond the outermost portion of the vessel's rim.

The location of the tip of the outwardly projecting directed pouring spout on vessels of the present invention ensures that the liquid clears the rim and/or collar of the vessel at any angle or rate of pouring. The positioning of the tip of the outwardly projecting spout in relation to the external thread on vessels of the present invention is not only important for drip-free pouring over the rim of the vessel, but is also required to permit threading with a mating part, e.g., as when a spouted closure of the present invention is screwed back onto a bulk liquid container. Thus, the tip of the spout on vessels of the present invention must be sized and positioned so that it does not interfere with the natural threading action when the spouted vessel is applied to or otherwise engages a secondary vessel having complementary threads.

For greatest drip-free performance, spouts of the present invention have their tips extending as far up and out over the rim of the vessel as possible. In this regard, Applicant has learned that this distance can be maximized by extending the tip of the spout as far out as the outer diameter of a hypothetical extension of the external thread on the vessel in question.

Applicant has further learned that to avoid interference when threading the first vessel including the spout onto a secondary vessel having a complementary thread or vice versa, the tip of the spout is vertically aligned so as to coincide with the vertical pitch of the external thread on the first vessel. Vertical positioning of the tip of the spout could also correspond to some multiple of the vertical pitch of the external thread on the vessel, i.e., so that the tip of the spout coincides with a hypothetical extension of the helical thread structure on the exterior of the vessel. In this way, the cross-sectional profile of the tip of the spout acts as a thread itself and does not cause misalignment of the first vessel as it is being threadedly engaged by the complementary thread on the secondary vessel.

When a container of the present invention is angled for pouring, any liquid that drips from the tip of the spout will clear the edges of the rim of the container because the tip of the spout is positioned over and beyond the rim of the container.

In a particularly preferred embodiment of the present invention, any drips that do not flow off of the tip of the spout at the conclusion of a pouring cycle are reclaimed by a drainback channel or a reservoir that is provided between the outermost surfaces of the spout and the interior rim of the vessel on which the spout is mounted. Once the container is turned fully upright again after pouring, the surface tension of the liquid allows any drips that form on the outermost surfaces of the spout to flow along the underside of the lip of the spout and down into the drainback channel or reservoir. Because the drainback channel is preferably angled down into the vessel along both sides of the spout, excess liquid which reaches the drainback channel ultimately flows back into the bottom of the vessel. If the vessel is a closure, this liquid eventually drains back into a bulk liquid container when the closure is reapplied thereto.

The drainback channel employed in a particularly preferred embodiment of the present invention is useful for two reasons: it keeps excess drops of liquid which reach the outermost surfaces of the spout from running across the external threads on the container; and it is makes substantially mess-free pouring easier in an execution of the present invention wherein the tip of the outwardly projecting directed pour spout is very close to the rim of the container. For example, when the outwardly projecting directed pour spout of the present invention is employed on a closure of the type generally disclosed in commonly assigned Delmar R. Muckenfuhs U.S. Pat. No. 4,696,416 issued on Sep. 29, 1987 and hereby incorporated herein by reference, the tip of the pour spout must be very close to the rim of the closure because it must fit within the bounds of the transition piece when the closure is screwed onto the bulk container. In this instance, the drainback channel prevents any excess drops of liquid that accumulate on the underside of the tip of the outwardly directed pour spout after a dispensing cycle from forming a liquid bridge between the tip of the outwardly directed pour spout and the rim of the closure. Avoidance of this phenomenon is desirable because the liquid bridge can cause liquid being dispensed during a subsequent dispensing cycle to not drop straight off of the tip of the spout in a stream, but to be pulled underneath the spout by the old liquid product on this surface and run in a stream down the threads and the exterior surfaces of the vessel.

It is therefore most preferable to keep the area just below the outwardly directed spout of the present invention as free of liquid as possible. A reservoir or a drainback channel are used in particularly preferred vessels of the present invention to accomplish the foregoing objective and thereby further increase their functional and aesthetic performance.

BRIEF DESCRIPTION OF THE DRAWINGS

While the specification concludes with claims that particularly point out and distinctly claim the subject matter regarded as forming the present invention, it is believed that the invention will be better understood from the following detailed description with reference to the drawings in which:

DETAILED DESCRIPTION OF THE INVENTION

Figure 1:
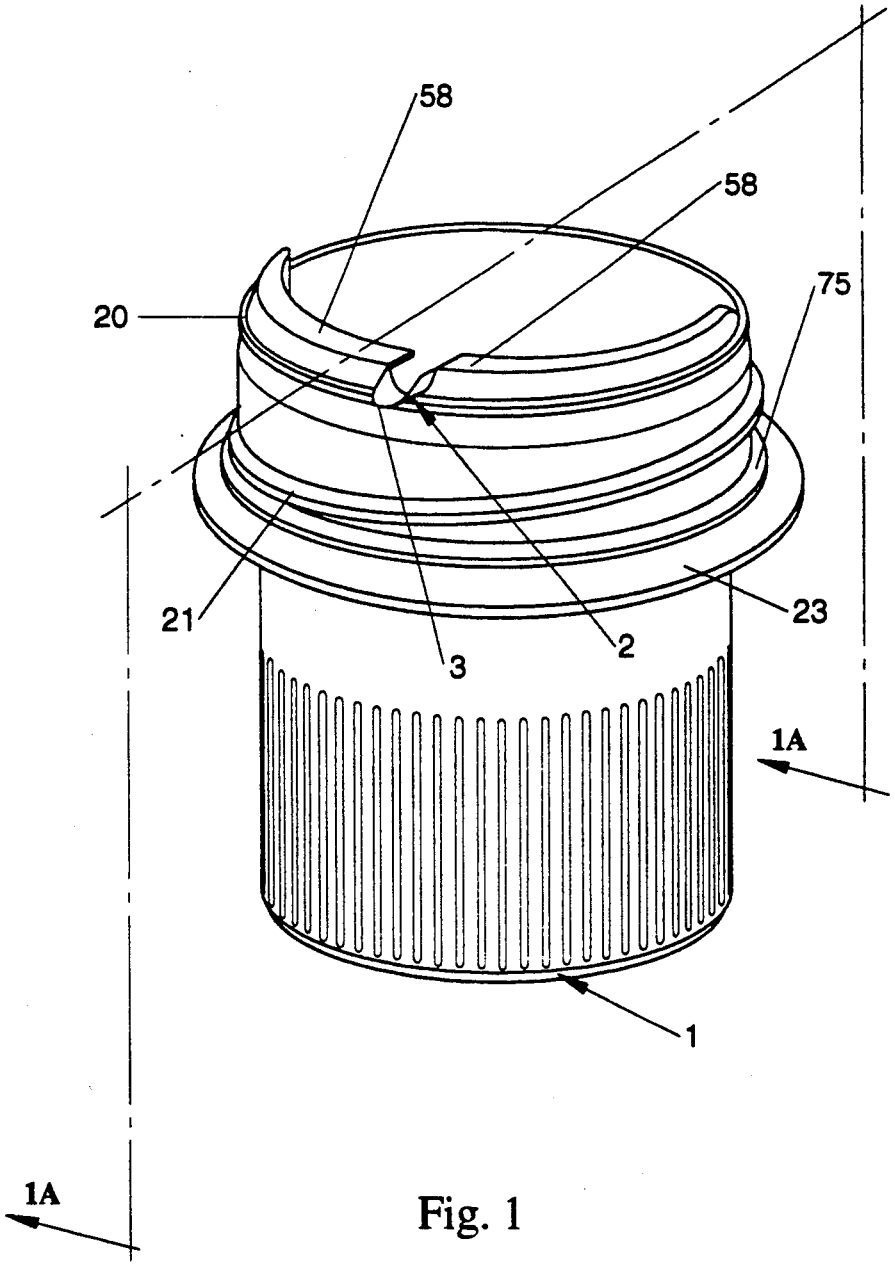
FIG. 1 is a simplified perspective view of a preferred embodiment of a vessel having an outwardly projecting directed pour spout of the present invention.

FIG. 1 is a simplified perspective view of an externally threaded vessel of the present invention comprising a closure having an outwardly projecting directed pouring spout 2.

Figure 1A:
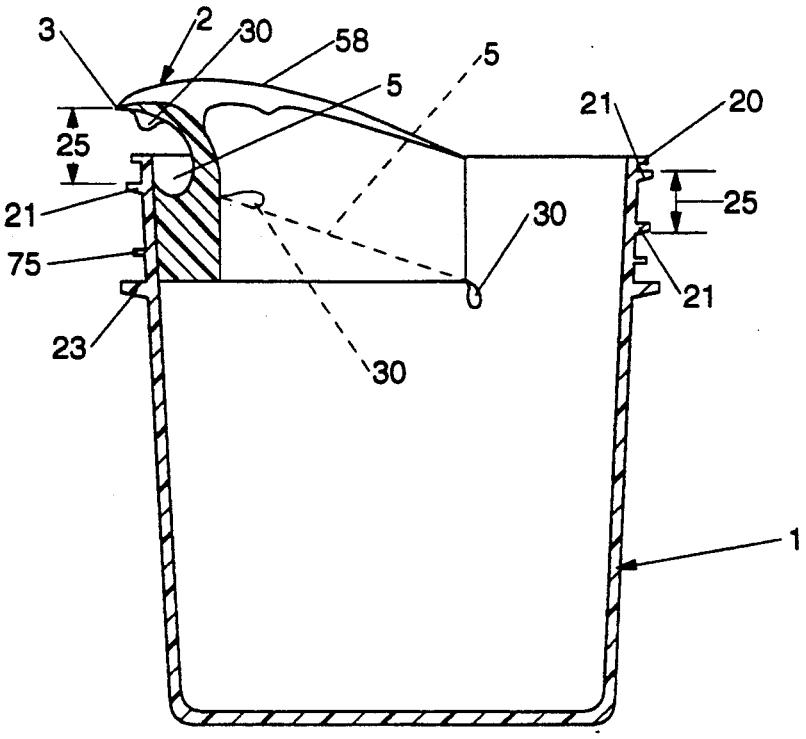
FIG. 1A is a cross-sectional view of the vessel of FIG. 1 taken along section line I—I of FIG. 1.

FIG. 1A is a vertical cross-sectional view of the externally threaded closure 1 shown in FIG. 1 taken at a point coinciding with section line I—I in FIG. 1 through the outwardly projecting directed pouring spout 2. Closure also includes an optional drainback channel 5 and an optional pair of dams 58 located on either side of the tip 3 of directed pouring spout 2 to provide dual function pouring capability, as generally disclosed in my concurrently filed, commonly assigned U.S. patent application entitled "VESSEL HAVING DUAL FUNCTION POURING SPOUT FOR SPOT TREATING OR RAPID TRANSFER OF VISCOUS FLUIDS", Ser. No. 717,455, the disclosure of which is hereby incorporated herein by reference. The closure is typically constructed of a moldable polymeric material, such as polypropylene.

The directed pouring spout 2, including dams 58, would need to be of the same material as the closure I if the entire closure with spout is injection molded as one piece. In this case, it would either be necessary to have a spout geometry which will allow the spout to be pulled off of the mold without damaging its shape, or a collapsible insert could be used in the molding process that would be easily removed from the interior of the closure without damaging the spout. Alternatively, the mold insert that forms the spout and interior of the closure could be comprised of two or more separate sections so that the side of the mold opposite the spout can slide out of the closure first. Then the other half of the mold that forms the undercut of the spout 2, including the optional dams 58, could be laterally shifted and removed.

If the spout 2 is molded as a separate piece and later inserted into the closure 1, it could be of a different moldable polymeric material than the closure, e.g., polyethylene. The spout insert could be adhered or heat sealed in place in closure 1, or it could be molded as a ring (not shown) and be press-fit into the rim of the closure 1.

The outermost tip 3 of the outwardly projecting directed pouring spout 2 is preferably as far out over the rim 20 of the closure 1 as possible (coincident with the maximum outer diameter of of helical thread 21) so that the liquid 30 will not come in contact with the rim 20, the external helical thread 21, the flexible sealing ring 75 or the coaxial shoulder 23 of the closure I during any angle of liquid pouring. Drawing FIGS. 1 and 1A illustrates that the vertical pitch 25 of the thread 21 is equal to the distance between the tip of the spout 3 and the portion of the thread 21 immediately below it. This permits the cross-sectional profile of the tip 3 of the spout 2 to actually act like a thread to help align the closure 1 when it is screwed onto a bulk liquid container (not shown).

In the particularly preferred embodiment shown in FIGS. 1 and 1A, an optional drainback channel 5 is provided between the innermost surface of the rim 20 of the container 1 and the outwardly directed pour spout 2. If any liquid 30 remains on the tip 3 of the spout 2 after the closure 1 is returned to its upright position after pouring, the surface tension of the liquid 30, combined with the slight upward angle of the bottom of the spout 2, allows the drip of liquid 30 to follow along the bottom of the spout and down along the drainback channel 5 until it drops back into the bottom of closure 1.

Figure 5:
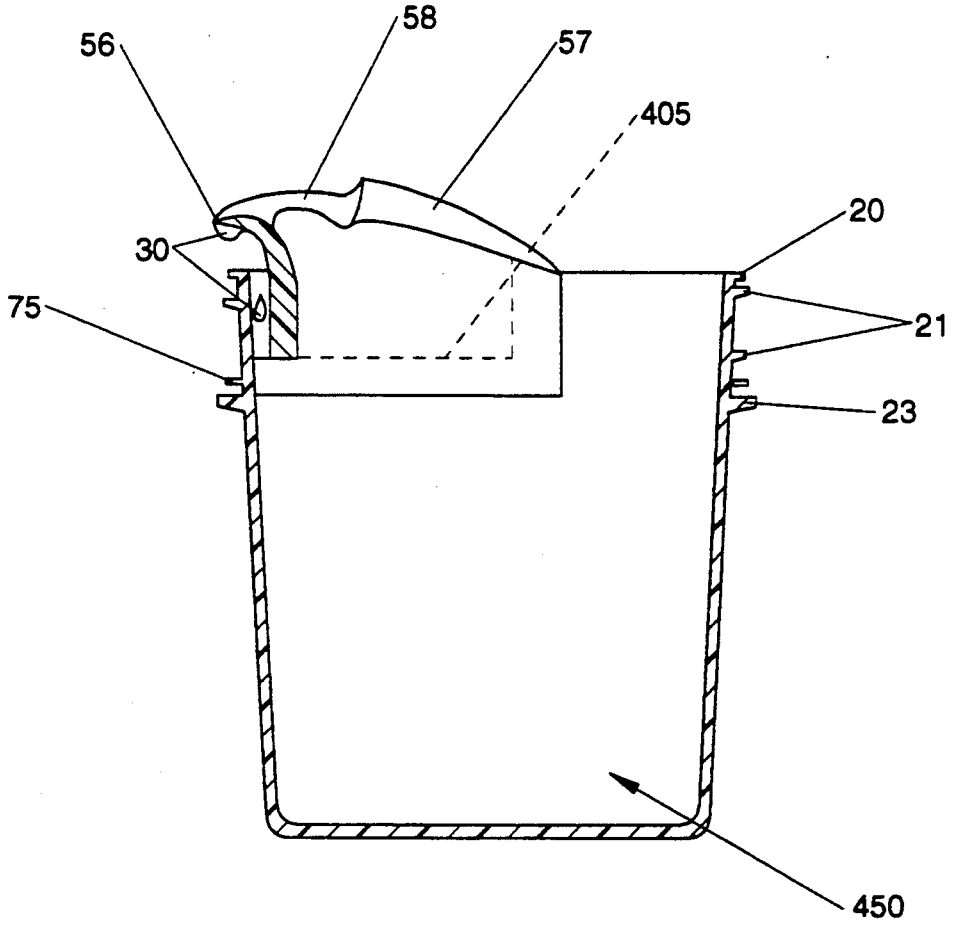
FIG. 5 is a simplified cross-sectional view of yet another alternative embodiment of a vessel, 450, of the present invention incorporating a drainback reservoir.

Alternatively, the optional drainback channel 5 could be replaced with a reservoir 405 shown in FIG. 5, particularly if the vessel in question comprises a closure. The reservoir will accumulate any drops of liquid 30 in the same manner as the drainback channel 5, but does not return them to the bottom of the vessel 1. Accordingly, the reservoir's capacity must be sufficient to keep the accumulated liquid 30 within its confines until the closure 1 is reapplied to a bulk liquid container.

Figure 2:
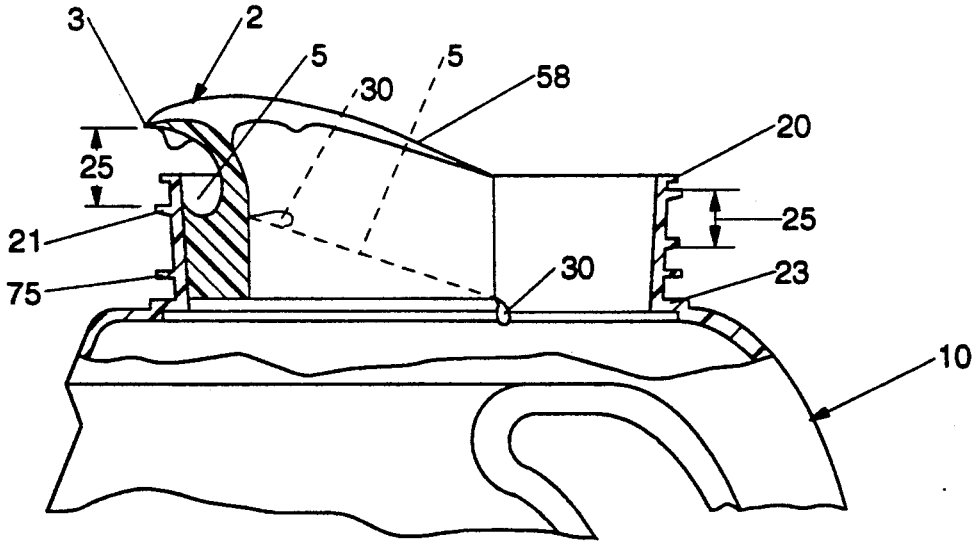
FIG. 2 is a partial cross-sectional view of a bulk liquid container having an outwardly projecting directed pouring spout of the present invention.

FIG. 2 is a partial vertical cross-sectional view of an externally threaded bulk container 10 of the present invention taken through the center of an outwardly projecting directed pour spout 2 having an optional drainback channel 5, generally similar to that shown in the closure embodiment 1 of FIG. 1. The bulk liquid container 10 is typically constructed of a moldable polymeric material, such as polyethylene or polypropylene.

Although technically feasible, it is unlikely that the bulk liquid container 10 with directed pouring spout 2 will be molded as one piece with current bottle blow molding methods and apparatus. It is most likely that the directed pouring spout 2 will be molded as a separate piece, inserted within a separately molded bulk liquid container and secured in place by adhesive, heat seals or friction fit, as generally described with respect to closure embodiment 1. The spout 2 is preferably molded out of a resilient polymeric material, such as polyethylene or polypropylene.

The spout 2 is preferably positioned so that its tip 3 will project the maximum possible distance out over the rim 20 of the container 10 so that the liquid will not come in contact with the rim 20, the external helical thread 21, the flexible sealing ring 75, the coaxial shoulder 23 or the exterior surfaces of the bottle 10 during any angle of pouring. This maximum outward projection of the tip 3 of pour spout 2 is limited by a hypothetical extension of helical thread 21.

FIG. 2 illustrates that the vertical pitch 25 of helical thread 25 is equal to the distance between the tip 3 of the spout 2 and the portion of helical thread 21 immediately below it. This permits the cross-sectional profile of the tip 3 of outwardly directed pour spout 2 to act like a thread to help align and engage a closure (not shown) having a complementary helical thread when the closure is screwed onto the bulk liquid container 10.

In the particularly preferred embodiment of the present invention shown in FIG. 2, an optional drainback channel 5 is also provided. If any liquid remains on the tip 3 of the spout 2 after completion of a pouring cycle, the surface tension of the liquid 30, combined with the slight upward angle of the bottom of the spout, allows the drip of liquid 30 to follow along the bottom of the spout until it reaches the drainback channel 5 from which it ultimately reenters the bulk liquid container 10.

Figure 3:
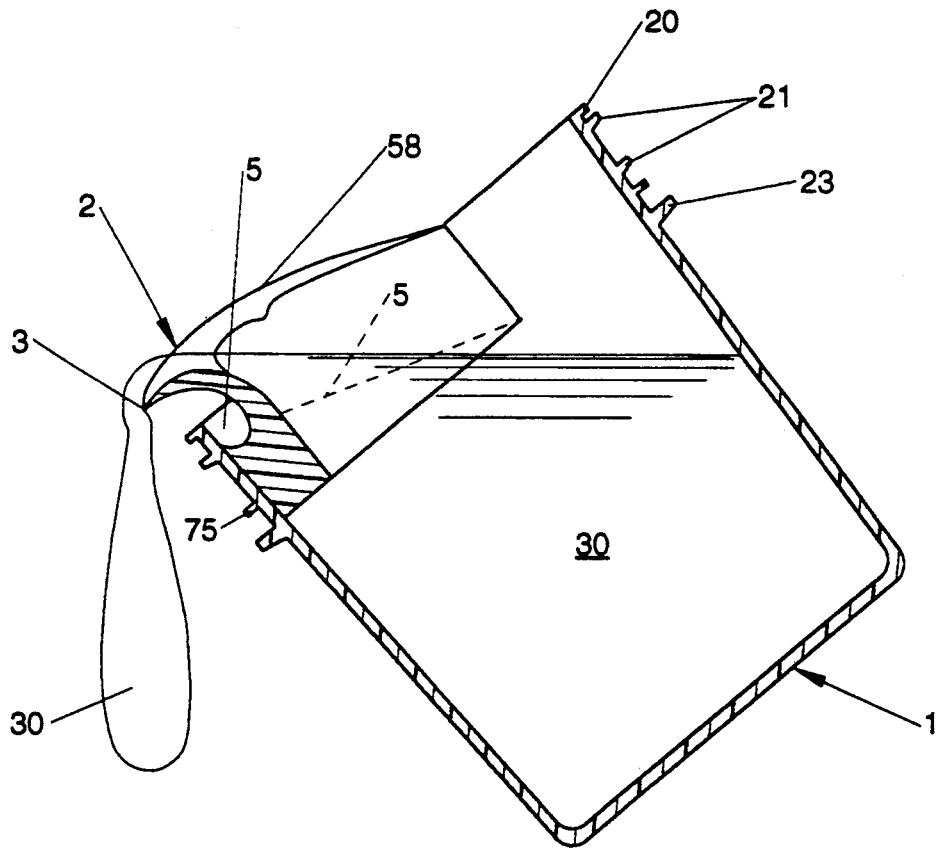
FIG. 3 is a cross-sectional view of the vessel of FIG. 1 shown as liquid is being directed through the outwardly projecting directed pour spout.

FIG. 3 is an in-use cross-sectional view of an externally threaded vessel 1 of the present invention of the type generally shown in FIGS. 1 and IA, said vessel having an outwardly projecting directed pouring spout 2 and an optional drainback channel 5. The drainback channel 5 prevents excess liquid 30 from previous pours from forming a liquid bridge between the tip 3 of the spout 2 and the rim 20 of the closure 1 because it is reclaimed by the drainback channel 5 between each successive pouring cycle.

Figure 4:
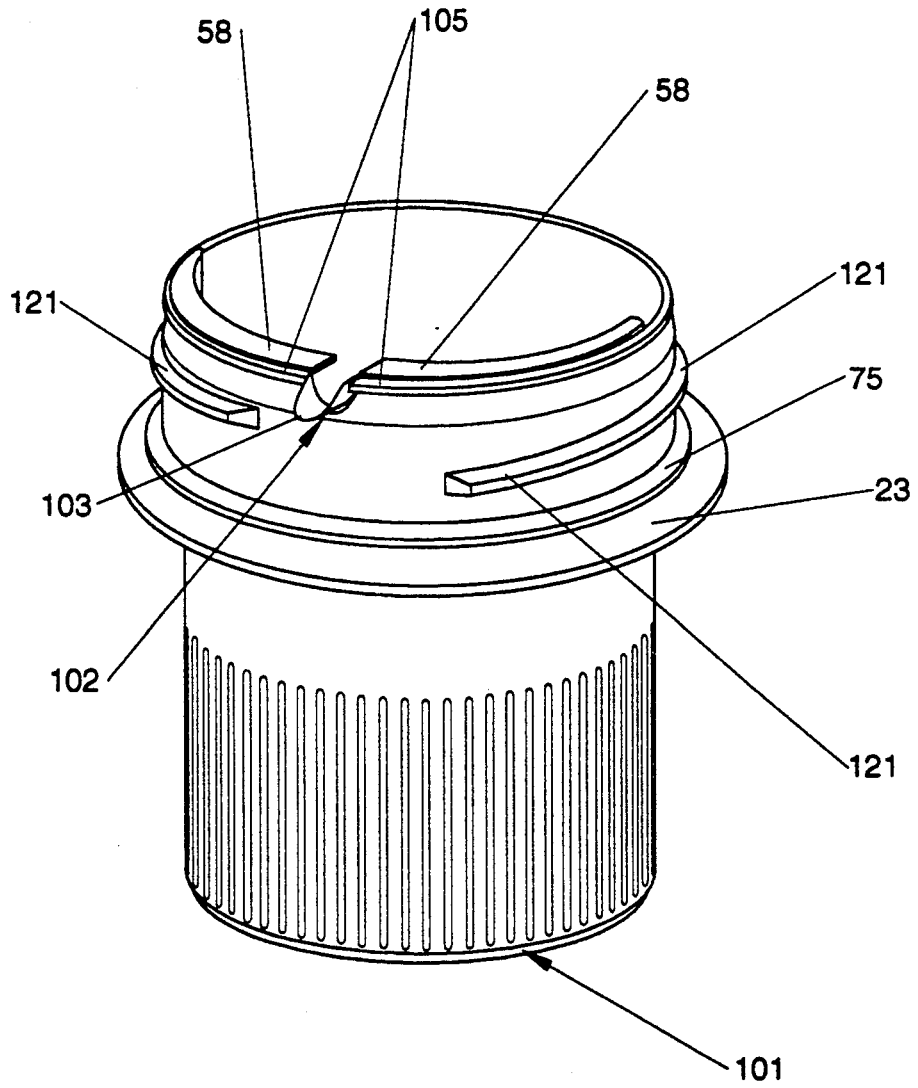
FIG. 4 is a perspective illustration of an alternative embodiment of a vessel having an outwardly projecting directed pour spout of the present invention.

Still another closure embodiment 101 of the present invention is illustrated in FIG. 4. The FIG. 4 closure embodiment 101 is generally similar to closure embodiment 1, with the exception that directed pouring spout 102 is coincident with the uppermost portion of helical thread 121 on closure 101. Thus, in the embodiment of FIG. 4 the cross-sectional profile of the tip 103 of outwardly projecting directed pour spout 102 coincides with an actual portion of helical thread 121 rather than a hypothetical extension thereof.

Closure embodiment 101, as shown in FIG. 4, also includes a pair of liquid restraining dams 58 located adjacent the directed pouring spout portion 102 to permit dual function dispensing of liquids under two different conditions of use without contamination of the external thread or the exterior surfaces of vessel 101. Slow dispensing of small quantities of liquid can be dispensed through directed pouring spout portion 102 (as might be used for pretreating articles of clothing to be laundered), and rapid dispensing of large quantities of liquid can be dispensed over the innermost edges of dams 58 (as might be used to rapidly transfer liquid detergent from a bulk liquid container to a washing machine).

Further details of the dual function pouring spout are fully disclosed in my concurrently filed, commonly assigned U.S. patent application entitled "VESSEL HAVING DUAL FUNCTION POURING SPOUT FOR SPOT TREATING OR RAPID TRANSFER OF VISCOUS LIQUIDS", Ser. No. 07/717,455, now U.S. Pat. No. 5,181,630, Attorney's Docket No. 4423, the disclosure of which is incorporated herein by reference.

In the vessel embodiment 101 shown in FIG. 4, an optional drainback channel 105 generally similar to drainback channel 5 on closure embodiment 1 is also provided to substantially prevent liquid bridging beneath the tip 103 of directed pour spout 102 and the exterior surfaces of the vessel 101.

While the present invention has been described in the context of vessels used to handle viscous liquids, such as laundry detergents, vessels of the present invention may be used with equal facility to dispense a wide range of liquids, e.g., fabric softeners, cooking oils, automotive fluids, and the like. In addition, it will be obvious to those skilled in the art that various changes and modification can be made to vessels of the present invention without departing from the spirit and scope of the present invention, and it is intended to cover in the appended claims all such modifications that are within the scope of this invention.

What is claimed is:

1. In a first externally threaded rimmed vessel which is used to pour liquid to an end use point and which is to be releasably secured to a second closed member with which a liquid tight seal is to be formed by means of complementary thread engaging means in said second closed member, the improvement wherein said first vessel includes an outwardly projecting directed pour spout extending beyond and above the rim of said first vessel to permit pouring of said liquid from said first vessel to a point of end use without contaminating the external thread or the exterior surfaces of said first vessel during said pouring operation, said outwardly projecting directed pour spout having a cross-sectional profile which resides completely within the outline which would be formed if said external thread on said first vessel were extended upwardly a sufficient distance to include the tip of said outwardly projecting directed pour spout, whereby said outwardly projecting directed pour spout may be threadedly engaged by said complementary thread engaging means on said second closed member without causing any misalignment or binding between said external thread on said first vessel and said complementary thread engaging means on said second closed member when said first vessel and said second closed member are releasably secured in liquid tight relation to one another.

2. The structure of claim 1, wherein said first vessel comprises a bulk liquid container and said second closed member comprises a closure member releasably secured thereto.

3. The structure of claim 1, wherein said first vessel comprises a closure member and said second closed member comprises a bulk liquid container.

4. The structure of claim 1, wherein said first vessel further includes a drainback channel between the innermost surface of said first vessel and the outermost surface of said spout, whereby any liquid remaining on the outermost surface of said spout after completion of a liquid pouring cycle will drain back into said drainback channel and ultimately back into said vessel intermediate successive liquid pouring cycles.

5. The structure of claim 1, wherein said first vessel further includes a drainback reservoir between the innermost surface of said first vessel and the outermost surface of said spout, whereby any liquid remaining on the outermost surface of said spout after completion of a liquid pouring cycle will drain back into said drainback reservoir after completion of a liquid pouring cycle, said drainback reservoir being emptied only when said first vessel is inverted and applied to said second closed member.

6. The structure of claim 5, wherein said first vessel comprises a closure member for a bulk liquid container.

7. In an externally threaded, rimmed closure member which is used to transfer liquid from a bulk liquid container to an end use point and which is to be releasably secured to said bulk liquid container by means of complementary thread engaging means, the improvement wherein said closure includes an outwardly projecting directed pour spout extending beyond and above the rim of said closure member to permit transfer of said liquid from said closure member to a point of end use without contaminating the external thread or the exterior surfaces of said closure member during said transfer operation, said outwardly projecting directed pour spout having a cross-sectional profile which resides completely within the outline which would be formed if said external thread on said closure member were extended upwardly a sufficient distance to include the tip of said outwardly projecting directed pour spout, whereby said outwardly projecting directed pour spout may be threadedly engaged by said complementary thread engaging means on said bulk liquid container without causing any misalignment or binding between said external thread on said closure member and said complementary thread engaging means on said bulk container when said closure member is releasably secured thereto.

* * * * *

UNITED STATES PATENT AND TRADEMARK OFFICE

CERTIFICATE OF CORRECTION

PATENT NO. : 5,228,596

DATED : July 20, 1993

INVENTOR(S) : Mark P. McNally

It is certified that error appears in the above-identified patent and that said Letters Patent is hereby corrected as shown below:

On the title page, under "other Publications":

Lines 4 and 5, "Transfer of Viscous Fluids, Ser. No. 717,456, filed Jun. 19, 1991", should read -- Transfer of Viscous Liquids, Ser. No. 717,455, filed Jun. 19, 1991 -- .

Column 4, line 2, "Closure also" should read - Closure 1 also -- .

Signed and Sealed this

Fifteenth Day of March, 1994

Bruce Lehman

*Attest:*

BRUCE LEHMAN

*Attesting Officer*

*Commissioner of Patents and Trademarks*